US008474082B2

(12) United States Patent
Fillon

(10) Patent No.: US 8,474,082 B2
(45) Date of Patent: Jul. 2, 2013

(54) CLEANING SYSTEM WITH BALLS, IN PARTICULAR FOR A HEAT EXCHANGER OF THE PLATE TYPE

(75) Inventor: Manuel Fillon, Paris (FR)

(73) Assignee: E. Beaudrey et Cie, Paris (FR)

( * ) Notice: Subject to any disclaimer, the term of this patent is extended or adjusted under 35 U.S.C. 154(b) by 737 days.

(21) Appl. No.: 12/635,041

(22) Filed: Dec. 10, 2009

(65) Prior Publication Data

US 2010/0146720 A1 Jun. 17, 2010

(30) Foreign Application Priority Data

Dec. 10, 2008 (FR) ..... 08 58455

(51) Int. Cl.
*B08B 9/057* (2006.01)
*F28G 1/12* (2006.01)

(52) U.S. Cl.
USPC ..... 15/3.5; 15/3.51; 165/95

(58) Field of Classification Search
USPC ..... 15/3.5, 3.51; 165/95
See application file for complete search history.

(56) References Cited

U.S. PATENT DOCUMENTS 5,598,889 A * 2/1997 Jackson ..... 165/95

FOREIGN PATENT DOCUMENTS

| | | |
|---|---|---|
| DE | 40 29 475 | 5/1922 |
| EP | 0 148 509 | 7/1985 |
| FR | 2 668 083 | 4/1992 |
| FR | 2 764 529 | 12/1998 |

OTHER PUBLICATIONS

French Search Report dated Jul. 10, 2009, from corresponding French application.

* cited by examiner

*Primary Examiner* — Randall Chin
(74) *Attorney, Agent, or Firm* — Young & Thompson

(57) ABSTRACT

A system includes an installation to be cleaned which has at an inlet a fluid feed pipe fed with fluid and at an outlet a fluid evacuation pipe. A cleaning device is arranged to cause cleaning bodies to flow in the installation, the cleaning device including on an inlet filter elements for filtering the fluid and on an evacuation pipe separator elements for collecting the cleaning bodies. The separator and filter elements are static and include separate filters, the separator elements including a filter member, the cleaning device including a circuit for recovering cleaning bodies circulating in the evacuation pipe and a circuit for reinjecting them into the inlet, the two circuits having in common the filter member and being used alternately by actuating a set of controlled valves in order to cause the fluid to flow either in the recovery circuit or in the reinjection circuit.

20 Claims, 5 Drawing Sheets

CLEANING SYSTEM WITH BALLS, IN PARTICULAR FOR A HEAT EXCHANGER OF THE PLATE TYPE

BACKGROUND OF THE INVENTION

Field of the Invention

The present invention concerns in a general way cleaning devices which, intended to intervene between water inlet and outlet pipes of an installation to be cleaned, use for cleaning the latter installation a charge of cleaning bodies circulated in said installation.

It is aimed more particularly, although not exclusively, at the situation where, this installation being a heat exchanger of the plate type, the cleaning bodies used are of relatively small size, for example of the order of 1 or 2 mm, and in practice take the form of balls or granules.

Description of the Related Art

One of the problems to be solved in the production of cleaning devices of this type relates to the necessity to separate these cleaning bodies from the treated flow in each cycle in order to reinject them into the flow for the next cycle.

To address this necessity it has been proposed to use separator means that cooperate with standard filter means that are inserted into the inlet pipes to stop any debris from varied sources, such as organic, vegetable or mineral debris, conveyed in the flow. These separator means are adapted to collect the cleaning bodies in the outlet pipe and to introduce the collected cleaning bodies into the inlet pipe.

In practice, the cleaning devices known at present are of two types.

1) In a first type of device the filter means are combined with the separator means.

To be precise, two filter baskets or strainers mounted on a rotary drum are directly placed, alternately, turn and turn about, on the inlet pipe and the outlet pipe.

Although such cleaning devices are satisfactory, in particular because they are self-cleaning, they nevertheless have the following drawbacks.

First of all, as these devices must alternately filter debris and recover the cleaning bodies, they can be properly adapted to both these functions only with difficulty.

In that they are placed on the inlet and outlet pipes, the latter pipes must be necessarily run locally side by side in parallel sections.

This frequently results in problems with the layout of the device as a whole.

Furthermore, on each rotation of the drum the outgoing flow is momentarily not intercepted by any basket. This results each time in a non-negligible loss of cleaning bodies.

Finally, because a filter basket in which the cleaning bodies gradually accumulate is placed on the outlet pipe in the cleaning body recovery phase, the head losses are in general not negligible.

2) In a second type of device, the mechanical filter means are specifically adapted to their function, i.e. filtering at the inlet and recovering the cleaning bodies at the outlet. The cycles of collecting the cleaning bodies on the downstream side and reinjecting them on the upstream side occur alternately in this case, and the head necessary to produce the flow is generated by venturis installed at the outlet of the filter located at the inlet and on the downstream side of the cleaning body collector located at the outlet. This applies to the system that is the subject matter of French patent 9012895.

This system, although much more advantageous than the previous one, nevertheless has a number of drawbacks.

The filter located at the inlet and the cleaning body collector located at the outlet are rotary devices and so are subject to wear and therefore require maintenance. Moreover, the collector filter located at the outlet, because of its rotation and the resulting shear forces between the cartridge and the blocking member, spoils a number of cleaning bodies on each cycle, which gradually reduces the effectiveness of cleaning and shortens the service life of each charge of cleaning bodies. At present, all such systems include at least one valve installed on the pipe connecting the cleaning body storage airlock to the venturi for injecting said bodies at the outlet of the inlet filter. This valve is open during each injection phase and closed during each collection phase and intercepts the water charged with cleaning bodies. It is either designed for a long service life, and is therefore produced in metal, with the major drawback of breaking cleaning bodies trapped between the threshold and the blocking member, or produced in flexible materials (as a sleeve valve, for example) and thus necessitates numerous maintenance operations but does not spoil the cleaning bodies, however.

SUMMARY OF THE INVENTION

A general object of the present invention is a cleaning device free from some or all of the above disadvantages.

A more particular object of the invention is a system comprising:

- an installation to be cleaned connected at the inlet to a fluid feed pipe fed with fluid and at the outlet to a fluid evacuation pipe,
- a device for cleaning the installation that is adapted to cause to flow in the installation cleaning bodies conveyed by the flowing fluid, the cleaning device including on the inlet pipe filter means for filtering the fluid and on the evacuation pipe separator means for collecting the cleaning bodies, characterized in that the separator means and the filter means are static and comprise separate filters, the separator means including a filter member, the cleaning device including a circuit for recovering cleaning bodies circulating in the evacuation pipe and a circuit for reinjecting recovered cleaning bodies into the inlet pipe, the two circuits having in common the filter member and being used alternately by actuating a set of controlled valves present in the portions of the circuits that do not convey the cleaning bodies in order to cause the fluid to flow either in the recovery circuit to collect in the filter member cleaning bodies coming from the pipe or in the reinjection circuit to drive the cleaning bodies collected in the filter member toward the pipe.

The invention separates the debris filtering and cleaning body recovery functions.

The corresponding filters can then be specifically and optimally adapted to their function, given that, being disposed upstream of the separator means, the filter means must provide finer filtration or in other words have a smaller mesh than the separator means.

The filter function is therefore exercised primarily by the filter means and the separator means are adapted to retain the cleaning bodies. The mesh of the separator means being larger than that of the filter means, the head loss generated by the flow of the fluid through the separator means is lower than previously.

Note that the controlled valves that allow fluid to flow and stop the flow of fluid in the recovery and reinjection circuits are in parts of the circuits that do not transport cleaning bodies.

There is therefore no risk of damaging the bodies when the valves close automatically.

It is to be noted that, by definition, a controlled valve is not a manually actuated valve. For example, it is a motorized valve.

According to one feature, the filter member includes an inlet and an outlet and is surrounded by a body, the inlet being connected to an upstream recovery pipe through which the cleaning bodies are transported towards the filter member before being collected by the latter, the outlet being connected to a downstream pipe for reinjecting cleaning bodies in the feed pipe, two pipes that are equipped with two controlled valves V2, V3 respectively being connected to the surrounding body upstream and downstream thereof respectively to bring and evacuate fluid therefrom depending on the controlled valves actuation.

Thanks to these valves located outside areas of circuits where the cleaning bodies pass it is thus possible to establish an appropriate flow of fluid and cleaning bodies. This circulation is adapted either to the recovery of these bodies or to their reinjection.

The fluid circulation is thus established in the appropriate circuit and stopped in the other circuit.

According to another feature, the recovery circuit comprises the recovery pipe, the filter member and the pipe equipped with the valve V2, whereas the reinjection circuit comprises the pipe equipped with valve V3, the filter member and the reinjection pipe.

According to one feature, the separator means further include another filter member placed on the evacuation pipe upstream of the filter member to stop the cleaning bodies and to allow the fluid to pass in the pipe.

This other filter member stops the cleaning bodies and allows the fluid to flow through the filter member in order to be evacuated from the system.

Thus on actuating a set of valves in the recovery and reinjection circuits when the fluid is to be caused to flow in the recovery circuit, the cleaning bodies are entrained by the fluid in the recovery circuit as far as the filter member common to the two circuits.

The cleaning bodies are stopped in the filter member and the fluid flows through said member to rejoin the downstream portion of the recovery circuit and to be introduced into the evacuation pipe downstream of the two filter members.

According to one feature, the cleaning body recovery circuit branches from the evacuation pipe so that the filter member stops the cleaning bodies flowing in the pipe and allows the fluid to flow into the downstream portion of the circuit in order to return it to the evacuation pipe when valve V2 is closed and valve V3 is open.

According to one feature, the cleaning body reinjection circuit branches from the inlet pipe in order to convey fluid taken from the pipe to the body and to cause it to enter the filter member to entrain the cleaning bodies into the downstream portion of the reinjection circuit and toward the inlet pipe when valve V2 is open and valve V3 is closed.

Thus, by taking water from the inlet pipe, the reinjection circuit creates a flow of water that entrains the cleaning bodies that have been collected in the filter member toward the downstream end of the circuit in order to reinject them into the inlet pipe.

Note that this reinjection of the cleaning bodies into the pipe is effected downstream of the point from which the fluid feeding the injection circuit is taken.

According to one feature, each of the cleaning body recovery and reinjection circuits includes means for creating suction in the circuit concerned in order to cause the flow of the fluid.

These means generate the motive force necessary for the fluid to flow in the circuits, given in particular the head losses caused in the system, for example in the filter means and in the filter member or members of the separator means.

More generally, these means, which could equally be referred to as pulsing means, are there to overcome the pressure differences that exist in the system.

According to one feature, these means include a venturi, which produces a very small head loss.

Alternatively, these means include a diaphragm that has the advantage of being less costly than a venturi.

According to a feature that is particularly beneficial if a small overall size is required, the filter member is a multicartridge filter including at the inlet a component for distributing the flow of fluid that includes a number of flow distribution passages each communicating with a filter cartridge, the assembly comprising the distributor component and the substantially parallel filter cartridges having an elongate general shape.

This structure is for example that of the filter member common to the two circuits and, where applicable, that of the other filter member of the separator means located on the recovery circuit upstream of the common member.

Note that the passages provided in this component are for example inclined to the longitudinal direction of the filter. They widen from the inlet face of the plate to the outlet face so that they can be connected to an upstream pipe with a diameter less than the transverse dimension of the set of filter cartridges.

These filter cartridges can in practice have a cylindrical general shape and the set of cartridges is advantageously arranged in an elongate manner in a longitudinal direction corresponding to the direction of flow of the fluid, for example.

This arrangement offers little disturbance of the flow of fluid and therefore minimizes head losses.

Thanks to the configuration of the filter member briefly described above, the cleaning bodies that are recovered therein are naturally concentrated in the downstream portion of the member which therefore continues to allow the fluid to flow over a great length.

In this way, the head losses caused by this filter member remain relatively low.

According to one particular feature, the filter cartridges of the aforementioned multicartridge member are each held in position at both their respective opposite ends.

Note that producing a multicartridge filter as briefly described above reduces the total length of the filter member and thus its overall size for equivalent filtering efficiency.

The separator means of the invention advantageously include no mobile mechanical members apart from the valves, which operate only momentarily. In the present invention, there are no valves that are operated during normal operation on the pipes in which the fluid charged with cleaning bodies passes.

Thus, the cleaning bodies in these pipes are damaged less than before, which reduces maintenance operations and proves less costly.

The system according to the invention is also directed to a system comprising an installation to be cleaned connected at the inlet to a fluid feed pipe fed with fluid and at the outlet to a fluid evacuation pipe, a device for cleaning the installation that is adapted to cause to flow in the installation cleaning bodies conveyed by the flowing fluid, the cleaning device including on the inlet pipe filter means for filtering the fluid and on the evacuation pipe separator means for collecting the cleaning bodies, characterized in that the separator means and the filter means are static and comprises separate filters, the separator means including a filter member provided with a filtering surface and that includes an inlet and an outlet, the cleaning device comprising an upstream recovery pipe connected to the inlet and a downstream reinjection pipe opening out in the feed pipe and that is connected to the outlet, the cleaning device also comprising a body surrounding the filter member, two pipes that are equipped with two controlled valves V2, V3 respectively being each connected to the surrounding body in order to respectively bring and evacuate fluid therefrom depending on the controlled valves actuation, when valve V2 is closed and valve V3 is opened the cleaning bodies circulating in the pipe are stopped by the filtering surface, whereas fluid conveying them passes through it in order to get out the filter member and is evacuated from the body by the pipe equipped with valve V3, when valve V2 is opened and valve V3 is closed fluid injected by the pipe equipped with valve V2 penetrates into the surrounding body, passes through the filtering surface in order to get into the filter member and drives the cleaning bodies in the reinjection pipe.

BRIEF DESCRIPTION OF THE DRAWING FIGURES

The features and advantages of the invention moreover emerge from the following description given by way of non-limiting example only with reference to the appended diagrammatic drawings, in which.

DETAILED DESCRIPTION OF THE INVENTION

The invention finds one particularly beneficial application in systematic cleaning of an installation, for example a heat exchanger of the plate type, through which travels a fluid such as water. The fluid could nevertheless be some other heat-exchange fluid.

Figure 1:
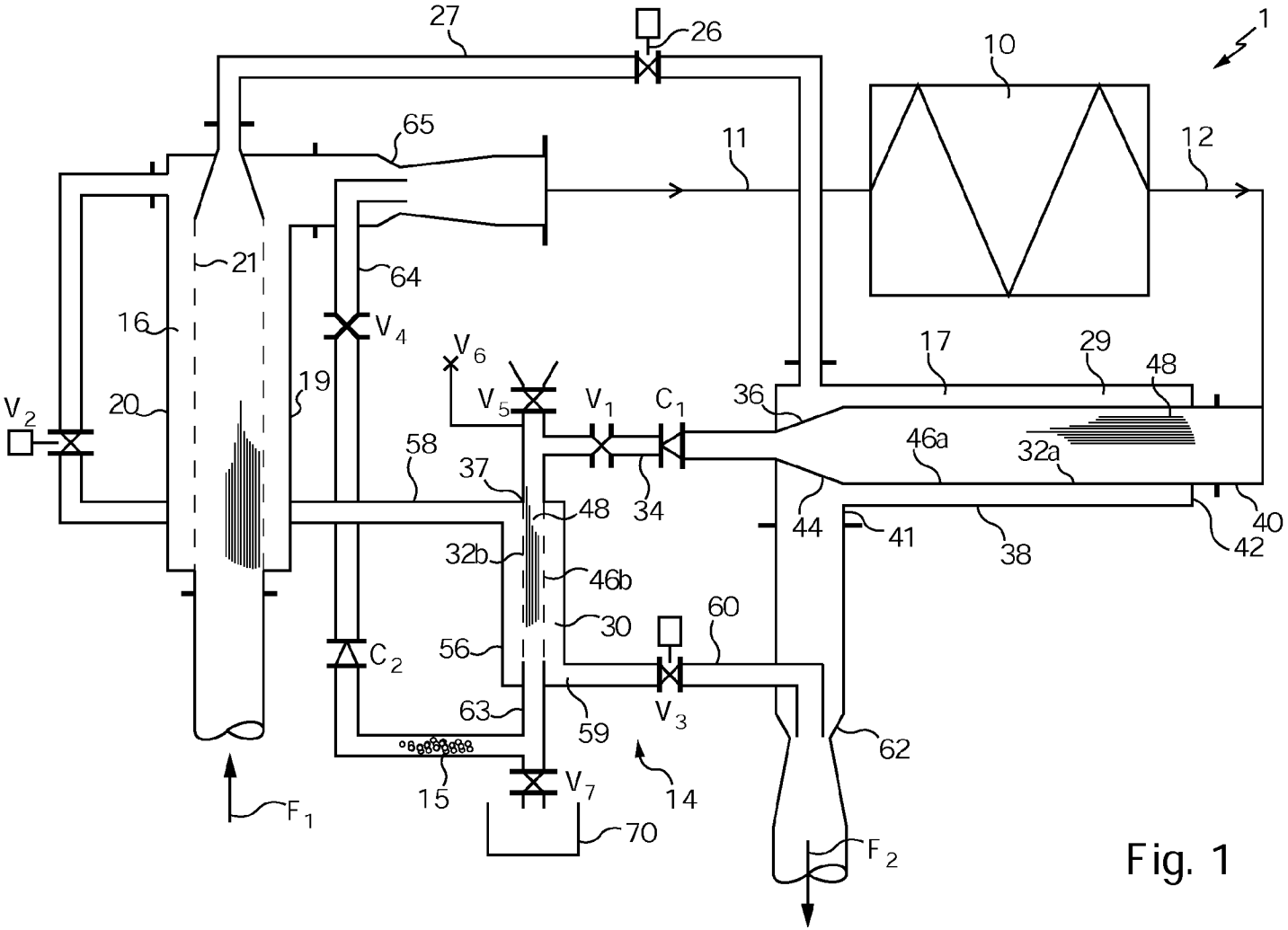
FIG. 1 is a block diagram of a cleaning device of the invention and the installation to which it is applied.

As represented in FIG. 1, the system 1 includes an installation 10 to be cleaned the inlet whereof is connected to a water inlet pipe 11.

The installation 10 is connected at its outlet to a water evacuation pipe 12.

The system also includes a cleaning device 14 which is more particularly the subject matter of the invention.

The cleaning device 14 used to this end is intended to operate between the inlet pipe 11 and the outlet pipe 12. It uses a charge 15 of cleaning bodies that is caused to flow in the installation 10 to be cleaned as and when required.

The cleaning bodies constituting this charge 15 are balls or granules of synthetic or mineral material, for example.

Their dimensions are small, for example between 1 and 2 mm inclusive.

Generally speaking, the cleaning device 14 includes separator means 17 that cooperate with filter means 16 inserted in the inlet pipe 11 and which, as described in more detail hereinafter, are adapted to collect the cleaning bodies constituting the charge 15 in the outlet pipe 12 and to reintroduce the collected cleaning bodies into the inlet pipe 11.

The filter means 16 include a filter 19 including in a globally cylindrical body 20 a fixed and globally cylindrical filter wall 21. The filter body 21 is cleaned by opening a valve 26 mounted on a pipe 27 connected to the downstream end of the filter body 21 and conveying washing water leaving the filter body 21 to the outlet pipe 12. The motive force generating the flow consists of the head loss of the circuit between the inlet of the filter 16 and the downstream side of the separator 17.

The corresponding provisions being well known in the art and not being relevant to the present invention, they are not described in more detail here.

Note that the mesh of the filtering wall 21 is sufficiently fine to stop debris carried by the flow F1 of water arriving via the inlet pipe 11.

The mesh is of the order of 0.5 mm, for example.

According to the invention, the filter means 16 configured as above and the separator means 17 employ separate static filters, in contrast to the prior art.

In other words, the separator means 17 of the invention do not cause intervention by the filter 19 of the filter means on the inlet pipe 11.

To the contrary, the separator means 17 use two dedicated filters 29, 30.

Very generally speaking, there are associated with the filters 29 and 30 a set of valves V1 to V7 and check valves C1 and C2 on the inlet pipe 11 and the outlet pipe 12 that are adapted to configure at least one pipe alternately in parallel or in series with flow through the filter wall of the corresponding filter in one case and without flow through that filter wall in the other case.

In the embodiment more particularly represented in FIG. 1, only one of the filters 29, 30, in this instance the filter 30, is liable in this way to be alternately branched from one or the other of the inlet pipe 11 and the outlet pipe 12. The filter 30 is disposed downstream of the filter 29 that serves as a concentrator for the filter 30, while the filter 30 serves as a collector.

In practice, the filter 29 is located directly on the outlet pipe 12 immediately downstream of the installation 10. It includes a filter member 32*a* which is placed in communication with the filter 30 under the control of a manual valve V1 mounted on a pipe 34 connecting the outlet of the filter 29 to the inlet 37 of the filter 30.

In practice, the filter member 32*a* of the filter 29 is disposed axially in a cylindrical body 38 and the outlet pipe 12 enters this body 38 axially in an inlet area 40 and leaves it laterally in an outlet area 41.

Accordingly, relative to the inlet portion of the outlet pipe 12, the filter member 32*a* is elongate in the longitudinal direction of flow of the water, i.e. in the longitudinal direction of the flow coming from the pipe 12.

The member 32*a* extends between a blocking plate 42 disposed transversely in the cylindrical body 38 and a convergent element such as a cone 44 connecting the filter member 32*a* to the outlet 36.

The flow of water entering the body 38 is therefore constrained to pass through the filter member 32*a*.

In practice, this filter member 32*a* takes the form of a cylindrical cartridge.

Figure 2:
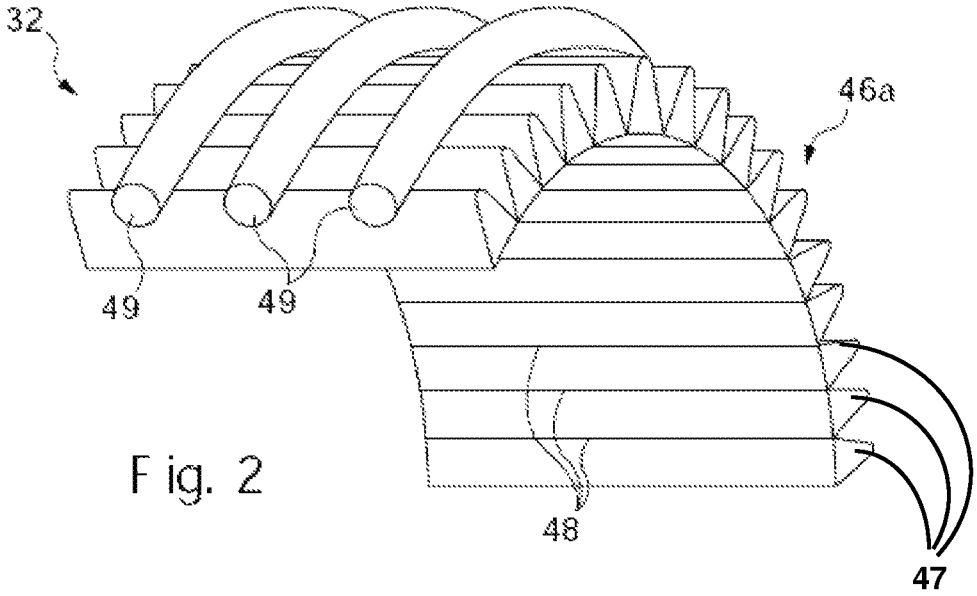
FIG. 2 is a partial view in perspective and to a larger scale of one of the filter members used in this embodiment.

As represented in FIGS. 1 and 2, it includes over at least part of its length a cylindrical filter wall 46*a* formed of wires 47 of triangular cross section that are spaced from each other and separated by parallel slots 48. To retain them, these wires are encircled externally by spacers 49.

Note that the slots 48 provided in the filter wall 46*a* are advantageously elongate in the longitudinal direction of the flow entering the filter member 32*a*.

The head loss induced by this filter member 32*a* is therefore low especially as, in the manner implemented here, this filter member 32*a* offers the water a large overall flow section.

The width of the slots 48 is for example between 0.8 and 1 mm inclusive.

Note that the filter wall 21 can be of the same construction except for the mesh size, which must be finer than that of the wall 46*a*.

In practice, the cone 44 forms a dead zone in line with the exit portion 41 of the outlet pipe 12 to prevent disturbance of the corresponding outgoing flow.

In the embodiment represented, the filter 30 serving as a collector includes in a body 56 a filter member 32*b* of the same type as the filter member 32*a* of the filter 29.

Thus the filter member 32*b* includes over at least part of its length a filter wall 46*b* with elongate slots in the longitudinal direction of the incoming flow present at the inlet 37 of the member.

The body 56 is fed by a pipe 58 connected to the inlet pipe 11 and controlled by the motorized valve V2.

Common to the body 56 and the corresponding filter member 32b, the inlet 37 in practice serves only the filter member.

The outlet 59 of the body 56 is connected to the outlet pipe 12 by a pipe 60 controlled by a motorized valve V3. In practice, the pipe 60 discharges into the outlet pipe 12 through a venturi 62 on the latter pipe in the vicinity of the outlet end of the system, from which the outlet flow F2 exits, downstream of the outlet from the pipe 27.

For its part, the outlet 63 of the filter member 32 of the filter 30 is connected to the input pipe 11 by a pipe 64 equipped with a check valve C2 and a manual isolating valve V4.

In practice, this pipe 64 discharges into the inlet pipe 11 through a venturi 65 on the latter pipe.

Finally, there is provided on the axis of the filter 30 and thus on the axis of its filter member 32*b* an inlet connector V5 mounted on the inlet 37 and adapted to enable checking of the state of wear of the cleaning bodies constituting the charge 15, if required, and the introduction of a new charge, if necessary.

In the embodiment represented in FIGS. 1 to 4, the valves V1, V2, V3, V4, V5, V6 and V7 are all two-port valves. Only the valves V2 and V3 need to be motorized and therefore adapted to be remote controlled, given the frequency of the cleaning body injection and recovery cycles. Note that the cleaning body injection and recovery cycle has a duration of the order of several tens of seconds, depending more particularly on the geometry of the circuit.

The valves V2 and V3 are sleeve valves, for example.

The valve V7 located at the outlet 63 of the filter removes the cleaning bodies from the circuit and collects them in a perforated basket 70, for example. A vent controlled by the valve V6 eliminates air when filling the member 29.

Note that the pipe 34, the filter member 30 and the pipe 60 form a cleaning body recovery circuit in which the cleaning bodies are transported through only a portion of the circuit, as far as the filter member. For its part, the fluid conveying the bodies up to that point can pass through the filter wall of the filter member and rejoin the pipe 60. The filter member 29 can optionally also be considered part of the recovery circuit.

Moreover, the pipe 58, the filter member 30 and the pipe 64 form a circuit for reinjecting cleaning bodies that are stopped on the interior wall of the filter member. The fluid that is allowed to flow in the circuit therefore enters the filter member and entrains the bodies out of the filter member and toward the downstream end of the circuit in order to reinject them.

Note that the filter member 30 is common to the aforementioned two circuits and is subjected alternately to two different flows of fluid either to store cleaning bodies in this member or to entrain them in the downstream direction from the storage (collection) point, depending on the imposed flow.

Generally speaking, the system of the invention includes a circuit portion 16 dedicated to filtration and a circuit portion dedicated to collecting/recovering cleaning bodies that includes a collector airlock intervening, turn and turn about, either in the high-pressure zone or in the low-pressure zone.

Operation of the System.

Figure 3:
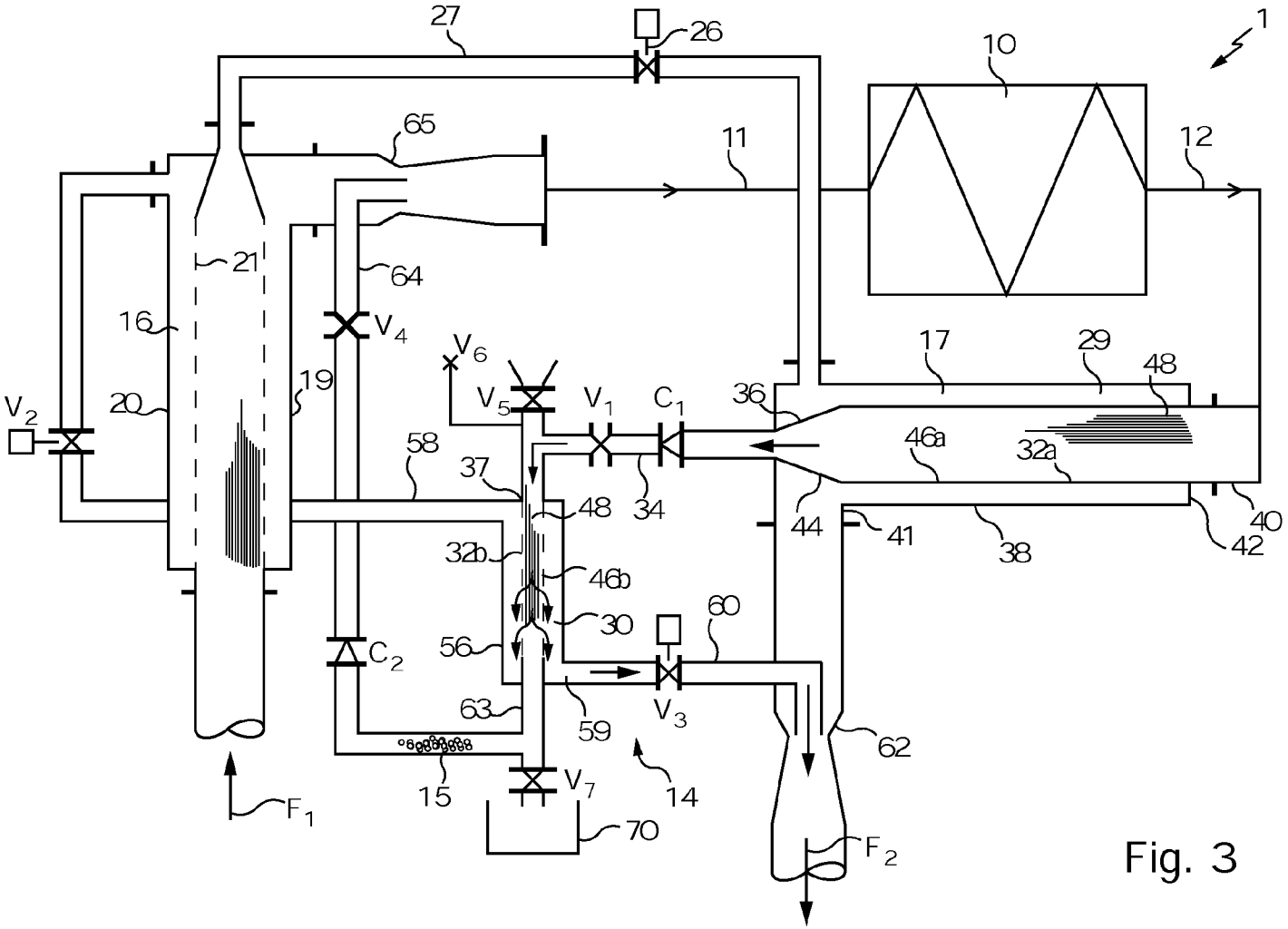
FIGS. 3 and 4 illustrate diagrammatically the circulation of fluid in the recovery and reinjection circuits, respectively.

Because of the pressures in the circuit, start-up begins with closing the valves V2, V3, V5, V6, V7 and the check valves C1 and C2. The isolating valves V1 and V4 are opened. The cleaning bodies stored beforehand in the collector 30 are reinjected into the pipe 11, establishing a flow of fluid in the aforementioned reinjection circuit, as shown in FIG. 3.

Figure 4:
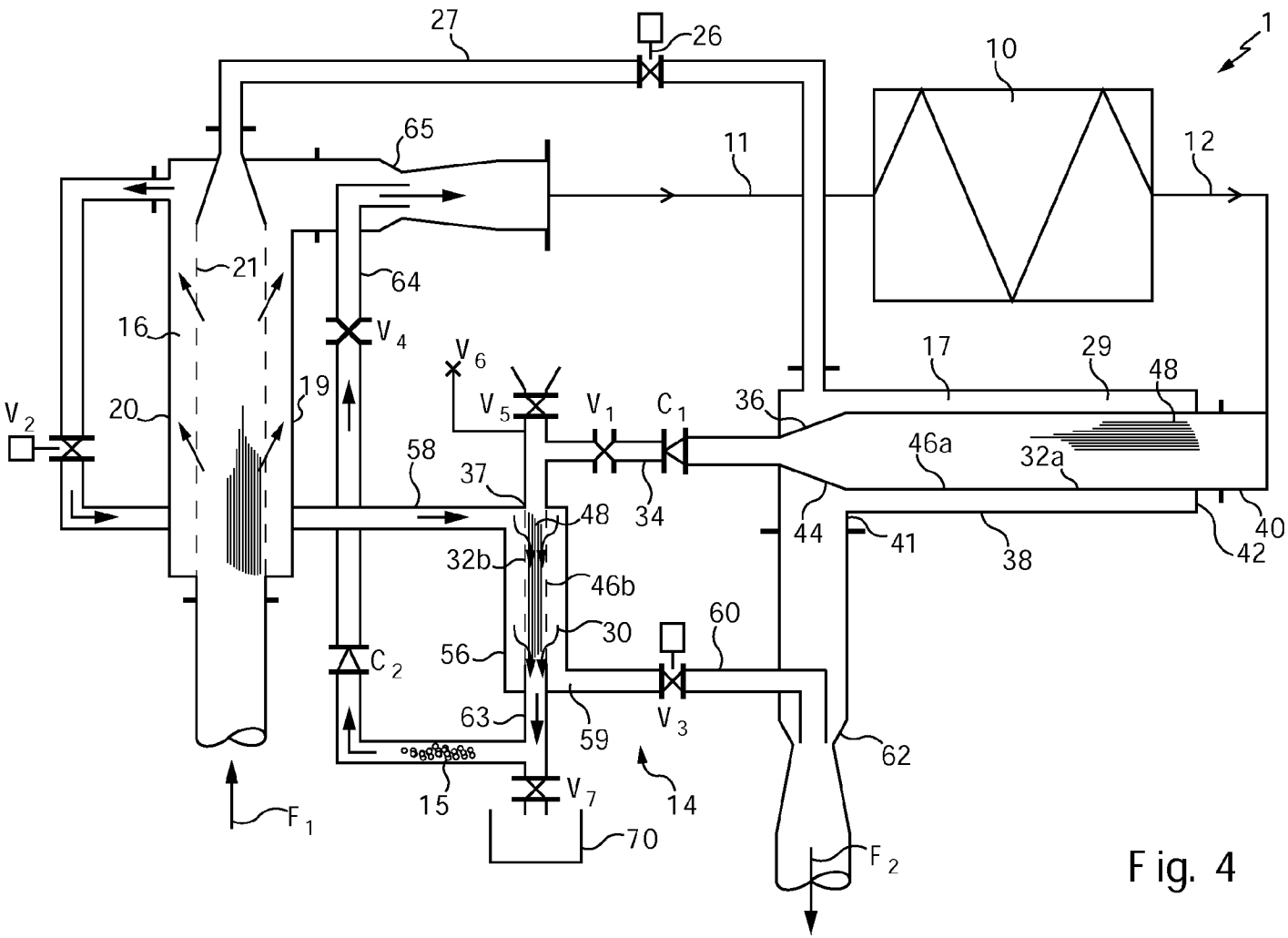

Actuation of the appropriate valves branches this circuit from the inlet pipe 11. More particularly, the cleaning bodies are injected into the installation 10 by opening the motorized valve V2. Because of the suction created by the venturi 65, the water taken off at the upstream pressure of the system flows in the pipework 58, enters the body 56 of the collector 30 that surrounds the filtering element 46*b*, passes through this filtering element 46*b* in contraflow, and entrains the cleaning bodies toward the outlet 63 of the collector and then into the pipework 64 via the check valve C2 and the valve V4. The cleaning bodies are then directed toward the installation 10 via the pipe 11. The pressure in the collector 30 being higher than that in the outlet pipe, the check valve C1 is kept closed. After a few seconds, all the cleaning bodies have been injected. The system is then switched to the cleaning body collection phase by establishing fluid flow in the aforementioned recovery circuit (FIG. 4). Thus this phase is initiated by closing the valve V2 and opening the valve V3. The bodies stopped by the filter body 46*a* are entrained by the flow of water that is established in the pipe 36 and are collected and stored in the filter member 46*b*. Because of the suction created by the venturi 62, the water then leaves the collector 30 via the outlet 59 and the pipe 60. The check valve C1 is kept open by the flow and the check valve C2 is kept closed by the pressure in the upstream part of the circuit, which is higher than that in the downstream part in which the collector 30 is located. Note that in this phase the recovery circuit branches from the outlet pipe 12.

Continuous or periodic repetition of the injection/collection cycle cleans the system 10 by virtue of the abrasive effect of the cleaning bodies passing over the heat exchange surfaces. Note that only the valves V2 and V3 are motorized and that the cleaning bodies are never in contact with these valves.

The cleaning bodies wear gradually over time and must then be changed. This is effected by first closing the valves V2, V3, V4, V5, V6 of the system and then opening the valve V7. The collector 30 is emptied and the worn cleaning bodies are stopped by the collection basket 70. The valve V7 is then closed and the valve V5 opened to introduce the charge of new cleaning bodies, after which the valve V5 is closed and the valve V6 is opened. The valve V3 is then opened, the collector 30 fills with water and the air in it is evacuated via the vent V6. When the collector 30 is full, the valves V3 and V6 are closed and the system is then ready to begin a cycle of cleaning the installation 10 with the new charge of cleaning bodies.

Periodic cleaning of the inlet filter 16 is totally independent of the operating cycles employing the cleaning bodies. It is effected by opening the valve 26, which creates a violent flow of water in the pipe 27 entraining clogging elements stopped on the filtering surface 21 toward the outlet of the system situated downstream of the concentrator 29. Cleaning can be triggered either by the operator or automatically by a programmed clock or by measuring the increase in the head loss in a manner known in the art.

The system as represented in FIG. 1 includes a single-cartridge input filter 16 and a single-cartridge separator 17. This simple arrangement is suitable for installations with a relatively low flow rate and therefore small diameter pipes 11 and 12. As the diameter increases, the filter 16 and the separator 17 become particularly long, which significantly increases the dimensions and thus the overall size of the system. To reduce the overall size, a number of filter bodies or cartridges are arranged in parallel in a single body. This causes no problems as far as the inlet filter 16 is concerned and therefore is not described in more detail here. Where the separator 17 is concerned, the nature of the cleaning bodies, which are generally small diameter granules, creates a number of problems. The granules tend to accumulate in all dead zones of the pipes of the system, i.e. zones in which the speed of the water is low or zero. Granules that are no longer flowing no longer clean the system 10. Note that the separator can equally well be produced in multicartridge form provided that it has no areas propitious to depositing the cleaning bodies.

Figure 6:
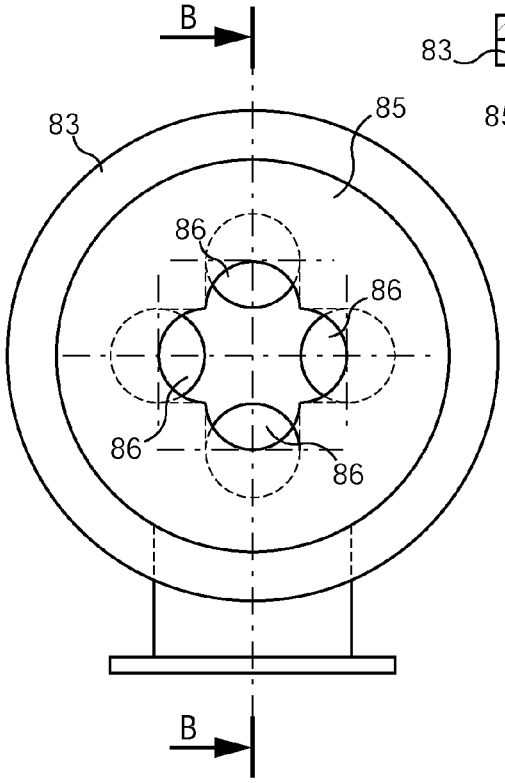
FIGS. 5 and 6 represent respectively in section and from above a variant of the granule separator for large pipework circuits.
Figure 5:
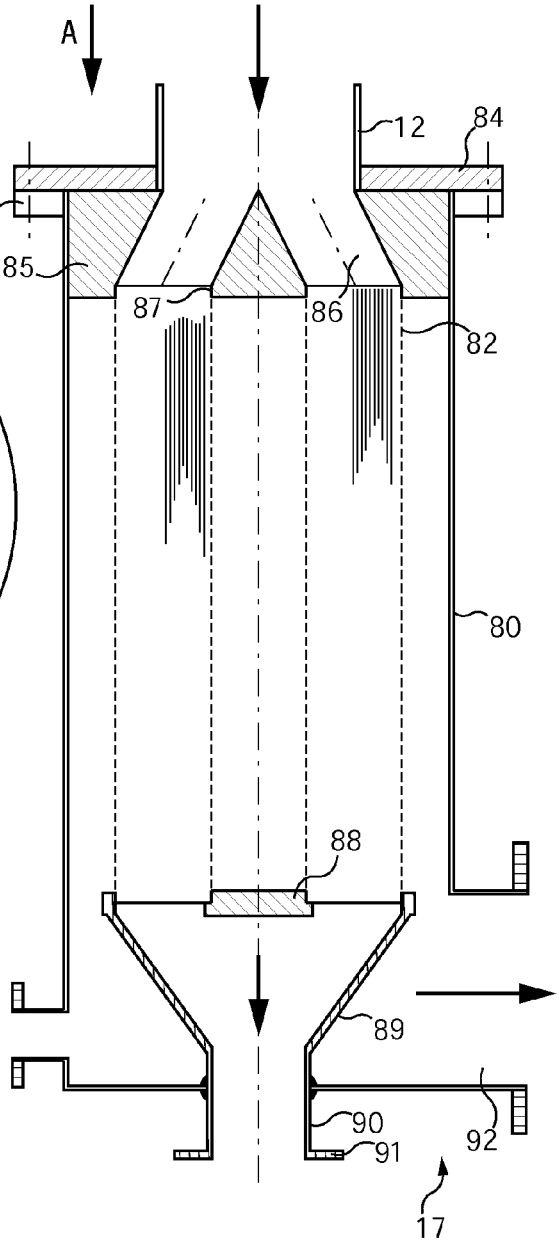

FIGS. 5 and 6 show separator means that can be included in the system from FIG. 1.

FIG. 5 is a view in longitudinal section of the separator filter 29 from FIG. 1 and FIG. 6 is a view of the separator from above, in the direction of the arrow A, with the pipework 12 removed for clarity.

The filter includes a globally cylindrical body 80 forming the filter envelope and in which are disposed a number of filtering bodies 82 which have globally cylindrical shapes parallel to the axis of the body 80, for example. Water enters the filter at an end of the body equipped with a flange 83 to which a flange 84 fastened to the pipework 12 is fixed.

The flange 83 is more particularly mounted around a component 85 for distributing the stream. This component, which takes the form of a thick plate, for example (a circular plate, for example), has an outside diameter equal to the inside diameter of the body 80.

It includes a feed pipe or passage 86 for each filter body (cartridge) 82 that feeds said body from the water inlet. There are therefore as many passages 86 as there are strainers.

The arrangement of the passages in the distribution plate 85 is such that there are no dead zones in which cleaning bodies could settle and remain.

Such a distribution plate is not necessary if the separator filter 29 is produced in the form of a multicartridge filter because in such a filter the problem of the existence of a dead zone does not arise in relation to the cleaning bodies.

Note that the filter bodies 82 are not necessarily all identical.

These passages are inclined to the longitudinal axis of the body 80 so that all the feed openings on the upstream face of the plate 85 (the openings visible in FIG. 6) are inscribed within a circle delimiting the flow section of the inlet opening of the pipe 12 at the location of the flange 84.

The outlet opening of each of the passages 86 includes a recess 87 in the plate 85 that holds the filter body 82 in position.

In the downstream portion, the filter bodies 82 are held in recesses in a plate 88 of a cone 89 for collecting the cleaning bodies and washing water. Thus the filter bodies are held in position in the body 80 at each of their two opposite longitudinal ends.

The filter bodies and the washing water leave axially via a tube 90 equipped with a flange 91. For its part, the main flow of water with the filter bodies removed exits via the radial pipework 92 likewise situated towards the downstream end of the body 80.

It must be noted that the filter constructed in this way has no zones in which cleaning bodies could stagnate and reduce the overall efficiency of the cleaning system. Furthermore, given its filtration efficiency, this filter has a relatively small overall size in the longitudinal direction compared to an arrangement including only one longitudinal filter of equivalent filtration efficiency.

In a variant that is not shown, for economic reasons, and if the overall head loss of the circuit is not critical, the venturis that generate the flow and cause only a minimum head loss in the circuit can be replaced by diaphragms. Downstream of these diaphragms the pipes 60 and 64 rejoin the main filtered water inlet pipe 11 and the main water outlet pipe, respectively.

The invention claimed is:

1. A system comprising:

an installation to be cleaned connected at an inlet to a fluid feed pipe fed with fluid and at an outlet to a fluid evacuation pipe, a device for cleaning the installation by causing to flow in the installation cleaning bodies conveyed by flowing fluid, the cleaning device including on an inlet pipe filter means for filtering the fluid and in an evacuation pipe separator means for collecting the cleaning bodies, wherein the separator means and the filter means are static and comprise separate filters, the separator means including a filter member, the device for cleaning including a recovery circuit for recovering the cleaning bodies circulating in the evacuation pipe and a reinjection circuit for reinjecting recovered cleaning bodies into the inlet pipe, the two circuits having in common the filter member and being used alternately by actuating a set of controlled valves present in portions of the circuits that do not convey the cleaning bodies in order to cause the fluid to flow either in the recovery circuit to collect in the filter member the cleaning bodies coming from the evacuation pipe or in the reinjection circuit to drive the cleaning bodies collected in the filter member toward the inlet pipe.

2. The system according to claim 1, wherein the filter member includes an inlet and an outlet and is surrounded by a body, the inlet being connected to an upstream recovery pipe through which the cleaning bodies are transported towards the filter member before being collected by the the filter member, the outlet being connected to a downstream pipe for reinjecting cleaning bodies in the feed pipe, two pipes that are equipped with two controlled valves V2, V3 respectively being connected to the surrounding body upstream and downstream thereof respectively to bring and evacuate fluid therefrom depending on the controlled valves actuation.

3. The system according to claim 2, wherein the recovery circuit comprises the recovery pipe, the filter member and the pipe equipped with the valve V2, and the reinjection circuit comprises the pipe equipped with valve V3, the filter member and the reinjection pipe.

4. The system according to claim 2, wherein the cleaning body recovery circuit branches from the evacuation pipe so that the filter member stops the cleaning bodies flowing in the pipe and allows the fluid to flow into the downstream portion of the circuit in order to return the fluid to the evacuation pipe when valve V2 is closed and valve V3 is open.

5. The system according to claim 2, wherein the cleaning body reinjection circuit branches from the inlet pipe in order to convey fluid taken from the pipe to the body and to cause it to enter the filter member to entrain the cleaning bodies into the downstream portion of the reinjection circuit and toward the inlet pipe when valve V2 is open and valve V3 is closed.

6. The system according to claim 1, wherein the separator means further include another filter member placed on the evacuation pipe upstream of the filter member to stop the cleaning bodies and to allow the fluid to pass in the pipe.

7. The system according to claim 1, wherein each of the cleaning body recovery and reinjection circuits includes means for creating suction in the circuit concerned in order to cause the flow of the fluid.

8. The system according to claim 7, wherein the means for creating suction in the circuit are arranged in the farthest portion of the circuit in the downstream direction.

9. The system according to claim 7, wherein the means for creating suction in the circuit include a venturi.

10. The system according to claim 7, wherein the means for creating suction in the circuit include a diaphragm.

11. The system according to claim 1, wherein the filter member is a multicartridge filter including at the inlet a component for distributing the flow of fluid that includes a number of flow distribution passages each communicating with a filter cartridge, the assembly comprising the distributor component and the substantially parallel filter cartridges having an elongate general shape.

12. The system according to claim 11, wherein the filter cartridges are each held in position at both their respective opposite ends.

13. A system comprising:

an installation to be cleaned connected at an inlet to a fluid feed pipe fed with fluid and at an outlet to a fluid evacuation pipe, a cleaning device for cleaning the installation that causes to flow in the installation cleaning bodies conveyed by flowing fluid, the cleaning device including on an inlet pipe filter means for filtering the fluid and in the evacuation pipe separator means for collecting the cleaning bodies, wherein the separator means and the filter means are static and comprises separate filters, the separator means including a filter member provided with a filtering surface and that includes an inlet and an outlet, the cleaning device comprising an upstream recovery pipe connected to the inlet and a downstream reinjection pipe opening out in the feed pipe and that is connected to the outlet, the cleaning device also comprising a body surrounding the filter member, two pipes that are equipped with two controlled valves V2, V3 respectively being each connected to the surrounding body in order to respectively bring and evacuate fluid therefrom depending on the controlled valves actuation, when valve V2 is closed and valve V3 is opened the cleaning bodies circulating in the pipe are stopped by the filtering surface, whereas fluid conveying the cleaning bodies passes through the filter member in order to exit the filter member and is evacuated from the body by the pipe equipped with valve V3, when valve V2 is opened and valve V3 is closed fluid injected by the pipe equipped with valve V2 penetrates into the surrounding body, passes through the filtering surface in order to get into the filter member and drives the cleaning bodies in the reinjection pipe.

14. A system comprising:

an installation to be cleaned connected at an inlet to a fluid feed pipe fed with fluid and at an outlet to a fluid evacuation pipe, a device for cleaning the installation by causing to flow in the installation cleaning bodies conveyed by flowing fluid, the cleaning device including on an inlet pipe filter adapted for filtering the fluid and in an evacuation pipe a separator adapted for collecting the cleaning bodies, wherein the separator and the filter are static and comprise separate filters, the separator including a filter member, the device for cleaning including a recovery circuit for recovering the cleaning bodies circulating in the evacuation pipe and a reinjection circuit adapted for reinjecting recovered cleaning bodies into the inlet pipe, the two circuits having in common the filter member and being used alternately by actuating a set of controlled valves present in portions of the circuits that do not convey the cleaning bodies in order to cause the fluid to flow either in the recovery circuit to collect in the filter member the cleaning bodies coming from the evacuation pipe or in the reinjection circuit to drive the cleaning bodies collected in the filter member toward the inlet pipe.

15. The system according to claim 14, wherein the filter member includes an inlet and an oulet and is surrounded by a body, the inlet being connected to an upstream recovery pipe through which the cleaning bodies are transported towards the filter member before being collected by the filter member, the outlet being connected to a downstream pipe adapted for reinjecting cleaning bodies in the feed pipe, two pipes that are equipped with two controlled valves V2, V3 respectively being connected to the surrounding body upstream and downstream thereof respectively to bring and evacuate fluid therefrom depending on the controlled valves actuation.

16. The system according to claim 15, wherein the recovery circuit comprises the recovery pipe, the filter member and the pipe equipped with the valve V2, and the reinjection circuit comprises the pipe equipped with valve V3, the filter member and the reinjection pipe.

17. The system according to claim 15, wherein the cleaning body recovery circuit branches from the evacuation pipe so that the filter member stops the cleaning bodies flowing in the pipe and allows the fluid to flow into the downstream portion of the circuit in order to return the fluid to the evacuation pipe when valve V2 is closed and valve V3 is open.

18. The system according to claim 15, wherein the cleaning body reinjection circuit branches from the inlet pipe in order to convey fluid taken from the pipe to the body and to cause it to enter the filter member to entrain the cleaning bodies into the downstream portion of the reinjection circuit and toward the inlet pipe when valve V2 is open and valve V3 is closed.

19. The system according to claim 14, wherein the separator means further include another filter member placed on the evacuation pipe upstream of the filter member to stop the cleaning bodies and to allow the fluid to pass in the pipe.

20. The system according to claim 14, wherein each of the cleaning body recovery and reinjection circuits includes a suction source in the circuit concerned in order to cause the flow of the fluid.

* * * * *